US007975616B2

(12) United States Patent
Hill

(10) Patent No.: US 7,975,616 B2
(45) Date of Patent: Jul. 12, 2011

(54) BULLET FOR BLACK POWDER FIREARMS

(76) Inventor: Andrew Wayne Hill, Salem, NJ (US)

( * ) Notice: Subject to any disclaimer, the term of this patent is extended or adjusted under 35 U.S.C. 154(b) by 783 days.

(21) Appl. No.: 11/888,409

(22) Filed: Aug. 2, 2007

(65) Prior Publication Data

US 2009/0266264 A1 Oct. 29, 2009

(51) Int. Cl.
*F42B 14/02* (2006.01)

(52) U.S. Cl. ..... 102/526; 102/439; 102/524

(58) Field of Classification Search ..... 102/524, 102/526, 439
See application file for complete search history.

(56) References Cited

U.S. PATENT DOCUMENTS

| | | | | | |
|---|---|---|---|---|---|
| 245,994 | A * | 8/1881 | Carr | 102/501 |
| 2,234,165 | A * | 3/1941 | Hatcher et al. | 102/526 |
| 3,049,998 | A * | 8/1962 | Brown | 102/442 |
| 3,999,486 | A * | 12/1976 | Bower | 102/526 |
| 4,193,348 | A | 3/1980 | Halverson | |
| 4,417,521 | A | 11/1983 | Dahlitz | |
| 4,610,061 | A | 9/1986 | Halverson | |
| 4,610,205 | A | 9/1986 | Bentley | |
| 4,958,570 | A * | 9/1990 | Harris | 102/517 |
| 5,078,054 | A * | 1/1992 | Ashok et al. | 102/517 |
| 5,198,616 | A * | 3/1993 | Anderson | 102/501 |
| 5,443,010 | A | 8/1995 | Dahlitz | |
| 5,686,693 | A * | 11/1997 | Jakobsson | 102/501 |
| 6,401,622 | B1 * | 6/2002 | Brinkmann | 102/524 |
| 6,405,654 | B1 | 6/2002 | Smith | |
| 7,448,325 | B2 * | 11/2008 | Harrison | 102/524 |

* cited by examiner

*Primary Examiner* — Michael Carone
*Assistant Examiner* — Michael D David

(57) ABSTRACT

A projectile for cap and ball revolvers and black powder rifles including but not limited to muzzleloaders, black powder cartridges etc. A soft lead body, cylindrical in form and having a front band designed to hold the projectile firmly in place prior to firing. During it's travel in the rifled bore, it then imparts spin to the projectile improving accuracy, range, and making the projectile stable during impact with intended target. Outside diameter of band is not drastic enough to negatively affect trajectory.

8 Claims, 1 Drawing Sheet

BULLET FOR BLACK POWDER FIREARMS

FIELD OF THE INVENTION

The invention relates to a bullet or projectile for black powder firearms. A single forward band insures the projectile remain in place until being fired.

BACKGROUND OF THE INVENTION

The resurgence in black powder shooting has grown along with the cowboy action shooting sports. Trends have brought about renewed interest in vintage and reproduction black powder revolvers. Competitive shooting of vintage arms and the desire to hunt facilitates the need to improve on projectiles available to this small but growing group of shooters. The inventor acquired the machinery, tooling, and rights to market the prior art. This projectile consisted of a small conical bullet having a cupped heal and having only a single driving band located in the front of the projectile. The alloy of lead used to make the bullet was required to have a minimum hardness to be produced in mass. This forced the band to be narrow to make it function properly. The modification of production methods opened the opportunity to use softer lead material. New designs with wider bands of pure lead greatly improved the projectile. When loaded in a black powder revolver each cylinder is loaded and waits its turn before firing. Should the projectile move before it is fired the accuracy is severely damaged. On occasion a projectile of ball or conical form will advance and prevent the cylinder from rotating to the next chamber. This problem can be time consuming and may require repair by a professional. The prior art solved this problem creating other undesirable characteristics. Hunters were forced to use hard bullets at low velocities that would not give much expansion on impact. While the smaller band would hold to the cylinder the incidence of moving forward on recoil was small on the first shot but by five shots this would become more inclined to occur. Typically a six shot group might have four or five well placed shots but because of bullet movement the fifth or sixth shots would be more inclined to be fliers. Extreme temperatures heighten this problem as does increased charges. Reducing loads helps but velocities are low already so hunters in particular don't like this choice. This invention locks the projectile in place with the ability to resist movement during much greater recoil. Shooters understand that the recoil of a certain pounds of force is felt on the bullets in other chambers of the cylinders with each shot. It is the inventors' belief that an accumulated recoil force is developed from shot to shot. The properties of lead and its reaction to such treatment indicate that inertia will change the contact surfaces and release the bullet. The invention has significantly greater hold/lock despite being softer. This is from the increased width of the band. A wider band of soft lead has more adhesion than a narrow hard lead band. The lubricity of lead is higher when alloyed to be harder. Pure lead has the lowest lubricity rating and is actually binding and suitable for use in applications like gaskets, sealing etc. The principles that worked in a cap and ball revolver also prove to be advantageous to other black powder firearms. The invention when used in a muzzle-loading firearm loaded much easier than grooved conical bullets. Having only one band to engrave during loading, it relies on the soft bullet to upset and obturate in the bore. This seals the bore and allows one projectile to conform to the wide variations of muzzleloader rifle bores. This is valuable to older firearms where bores will vary more often. Current production barrels for muzzleloaders are not required to meet any industry standards. The Sporting Arms and Ammunition Manufacturers' Institute conducted a study that found that current production among the largest muzzleloader companies have barrel diameters varying by 0.003". When loading, the invention will align in the bore as the body diameter is at or slightly under the diameter of the lands. Only the band located to the front of the projectile will engrave the lands. This proper alignment eliminates one of the main reasons for poor accuracy, the misalignment and mangling of the projectile during loading. Damage to one side may cause sever gas cutting and thus leading of the bore. These factors also make the invention perform well in the low velocity black powder cartridge firearms.

SUMMARY OF THE INVENTION

Briefly, a soft metal projectile of cylindrical form and having a single rifling band located to the forward portion of the projectile. The cylindrical body portion just touches or is smaller than the diameter of the lands of the intended bore. The forward rifling band is of a size that it holds the bullet firmly in place in a chamber of a cap and ball revolver. Said bullet may be commercially manufactured by swaging to form or cast.

DETAILED DESCRIPTION OF THE INVENTION

Figure 1:
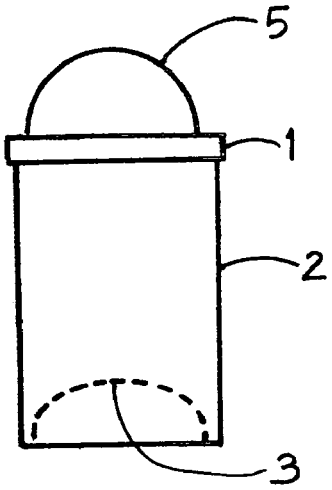
FIG. 1 and FIG. 2 are side views of the present invention.
Figure 2:
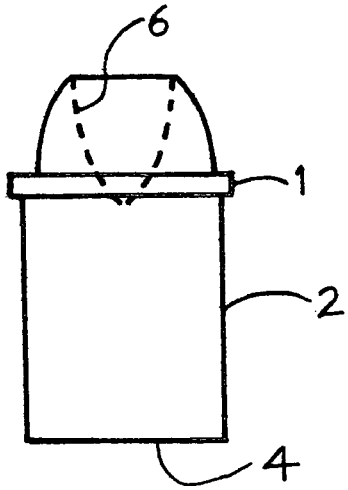
Figure 6:
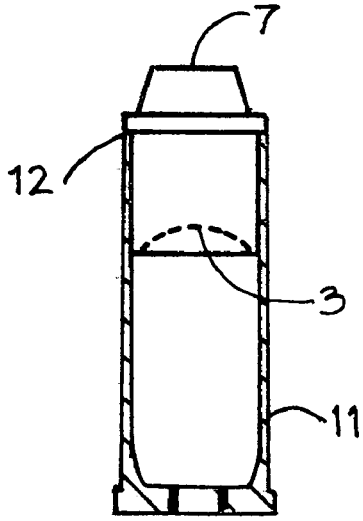
FIG. 6 depicts the typical use of the invention when loaded in a cartridge case.

Drawings FIG. 1 and FIG. 2 illustrate side views of the invention showing a cylindrical lead bullet having a forward wide band 1. The shank 2 is made to a dimension that allows it to fit easily in a bore or cylinder. The base may consist of a cupped recess 3 that aids in obturation of the bullet during the pressure wave caused from the ignition of propellant. A flat base design 4, is of greater advantage the longer the shank 2 is as the bullet will have a better chance to upset and seal the bore. Most popular nose styles can be used with this invention including round nose 5, hollow point 6, and semi-wadcutter 7, as depicted in FIG. 6.

Figure 3:
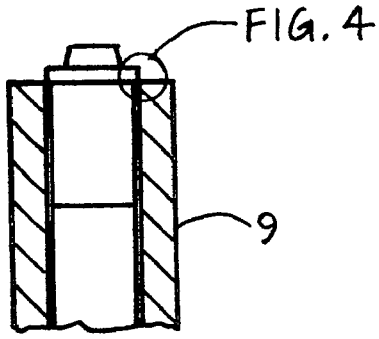
FIG. 3 shows the invention as it applies to a muzzle-loading firearm.
Figure 4:
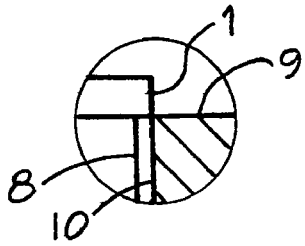
FIG. 4 is a closer detail showing the projectiles relationship to the rifling while loading in a muzzle-loader.
Figure 5:
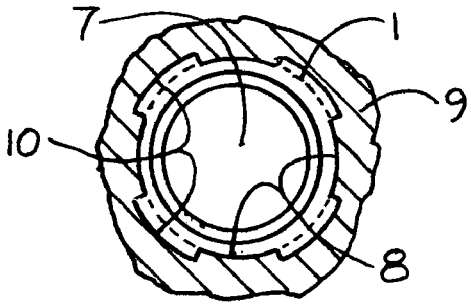
FIG. 5 is a front end sectional view of the bullet after having been seated into the barrel.

When loaded in a cap and ball revolver the band 1 locks the projectile in place holding it far better than standard round ball having a limited contact area. The invention consists of soft lead band 1 that is substantially wider than the prior art. The prior art could only be made of a hardened lead and thus had a narrow band that limited the usefulness and accuracy under low velocity applications to which it was made for. The hardened lead gave little if any expansion and was not known to be of much value terminally. FIG. 3 shows the invention dropped into a barrel of a muzzle loader and waiting to be seated/engraved into the rifling. FIG. 4 is a close-up of the contact area of the invention prior to being engraved into the rifling. Notice that the band 1 comes to a rest on top of the lands 8 and must be engraved into the rifling. The diameter of the shank 2 is such that it will pass into the barrel within a close tolerance. This starts the seating process assuring proper alignment prior to engraving the band 1 in the rifling. The forward band 1 is made to a diameter that it fits within the grooves 10 diameter. During ignition the rotational effect is imparted to the projectile via the band 1. A lube may be applied using the flood coating or dry lube methods. This protects the barrel 9 from leading. FIG. 5 illustrates the nose end of a seated bullet and it's relationship with the rifling after engraving. The diameter of the lands 8 has allowed the shank 2 to pass into the bore but the diameter of the band 1 stopped on the lands 8. The loader forcibly engraves the band 1 and makes it pass into the bore, as it is smaller than the groove 10 diameter as seen here. In FIG. 6 the invention is shown seated in a cartridge case 11. The forward band 1 seated all the way to the mouth 12 of the case making a positive stop for consistently accurate seating depth from one loaded round to the next. The wide band 1 of soft lead is particularly helpful in the older low velocity cartridges like the 38 Smith & Wesson, .40-82, .44 American, .44 Russian, .44 Webley, .44-40 Winchester, etc. The band 1 allows the projectile to conform to the forcing cone or lead and eventually the bore of the gun making the soft bullet "swaged to fit" during firing. Said invention is usable with black powder propellant and commercially available black powder substitutes.

I claim:

1. A bullet consisting of a cylindrical body rear section with a diameter, a forward tapering nose section, a single forward band located at the intersection of the rear section and nose section, the band composed of a malleable soft lead alloy or pure lead, wherein the band is substantially soft in order to allow adequate obturation in the barrel, that when used in cap and ball revolvers and the band being just at or under the diameter of the lands of the bore, the band locks the projectile firmly in the cylinder until fired despite repeated and compounded recoil, and when used in muzzle-loading rifles will easily load when the diameter of the band is at or under the lands diameter and only engraving at the forward band.

2. A bullet as defined in claim 1, that when used in low velocity cap and ball revolvers is soft to expand on game in hunting situations.

3. A bullet as defined in claim 1, that when used in a muzzle-loading firearm will consistently align more perfectly as it is being seated and thus eliminate a major contributor to poor accuracy.

4. A bullet as defined in claim 1, that when loaded in a black powder cartridge seats to the bottom of the forward band, providing a positive seating depth.

5. A bullet as defined in claim 1, wherein a dry lubricant is applied to the exterior.

6. A bullet as defined in claim 1, wherein a flood coated lubricant is applied.

7. A bullet as defined in claim 1, further including a hollow point.

8. A bullet as defined in claim 1, further including a depression in the base of the bullet.

* * * * *